United States Patent [19]

Spalding

[11] Patent Number: 4,483,251

[45] Date of Patent: Nov. 20, 1984

[54] CARTRIDGE FOR SMALL ARMS

[76] Inventor: Don Spalding, 3645 Buena Vista Dr., Sacramento, Calif. 95825

[21] Appl. No.: 318,478

[22] Filed: Nov. 5, 1981

[51] Int. Cl.[3] ..... F42B 5/28

[52] U.S. Cl. ..... 102/464; 102/430

[58] Field of Search ..... 102/464, 465, 466, 467, 102/468, 469, 470, 471, 472, 501, 430

[56] References Cited

U.S. PATENT DOCUMENTS

| | | | |
|---|---|---|---|
| 97,615 | 12/1869 | Depew et al. | 102/464 |
| 1,364,871 | 1/1921 | Ernst | 102/465 |
| 2,381,083 | 8/1945 | Shufflebotham | 102/466 X |
| 2,402,068 | 6/1946 | Meador . | |
| 2,831,287 | 4/1958 | Maillard . | |
| 3,171,350 | 3/1965 | Metcalf et al. | 102/467 |
| 3,771,451 | 11/1973 | Woodring | 102/430 |
| 3,797,396 | 3/1974 | Reed | 102/464 X |
| 3,830,157 | 8/1974 | Donnard et al. . | |
| 3,998,161 | 12/1976 | Booth . | |

FOREIGN PATENT DOCUMENTS

| | | | |
|---|---|---|---|
| 535372 | 4/1922 | France | 102/468 |

*Primary Examiner*—Harold J. Tudor

*Assistant Examiner*—Tyrone Davis

*Attorney, Agent, or Firm*—Leonard Bloom

[57] ABSTRACT

A cartridge for use with a revolver, automatic or submachine gun which includes a casing having a substantially linear outer wall, a transition bevel at one end of the casing which terminates in an extractor groove area, the groove area is connected to a base which includes an annular rim, a primer pocket extending through the base which communicates with an interior of the casing through a flash hole, the interior including a powder charge area having a planar bottom wall extending radially outwardly from the flash hole and terminates in a substantially elliptical section, the elliptical section communicating with an end opposed to the bevel of the casing through a sloped wall and thereafter a further neck section which is adapted to receive the bullet therewithin, this last neck section being of uniform thickness and substantially parallel to the outer casing, so that upon combustion and discharging of the bullet, a thickened wall is provided along the base of the cartridge, the thickness tapering in a specified manner so as to provide a cartridge not prone to deformation, a common cause jamming in automatic type weapons.

1 Claim, 3 Drawing Figures

10

3
2
12
9
C
14
15
11
6
7
8
11
12
4
5
18
9
1

10

3
2
9
15
B
12
13
14
11
19
6
7
9
4
5
16
1
17

11
3
8
13
12

CARTRIDGE FOR SMALL ARMS

BACKGROUND OF THE INVENTION

This invention relates generally to cartridges for automatic arms, and specifically .41 caliber cartridges.

It is well known that there are existing industry's standards for the external dimension of cartridges used in fire arms. For reliable service in arms and the like, the outside diameter of a cartridge, projectile diameter, flash hole dimension, primer pocket, must all be with in prescribed limits to assure utilization of a particular cartridge in a specific gun. For 0.41 caliber cartridges, the inner diameter of the upper portion of a cartridge should be .41 inches, and the overall length of the cartridge approximates 0.9 inches. Thus, the contour of the cartridge body is the only area where the performance of the bullet can be altered, thereby altering projectile velocity, within limits prescribed by the strength of the shell casing and the associated charge of powder contained therewithin.

The following patents reflect the state of the art of which applicant is aware in so far as these patents appear to be germane to the patent process.

U.S. Pat. No. 2,402,068 Meador
U.S. Pat. No. 2,831,287 Maillard
U.S. Pat. No. 3,830,157 Donnard et al.
U.S. Pat. No. 3,998,161 Booth Of these, the patent to Meador is of great interest since he teaches the use of ammunition having specific contours which effect the overall capabilities of the cartridge. FIG. 2 for example is directed to a cylindrical case blank prior to being tapered and necked in the appropriate fashion as suggested in FIG. 3, in which the inventor appreciates the need for walls of various thickness contingent upon the load imposed thereon. However, this device is suitably configured for cartridges made of steel and not brass as in the instant application, and therefore the contour and appropriate angulations reflect not only this difference but the fact that the forces generated in the Meador invention is designed for higher internal pressure, up to 50,000 psi in which 1,000 rounds per minute or more are fired. By way of contrast, forces according to the instant application very rarely exceed 35,000 psi and the cartridge according to the instant application is made of brass requiring different configurations. More specifically, the radius of curvature in the Meador patent is constant, and in the instant application the radius of curvature changes in an elliptical fashion with other variations in wall thicknesses for advantages to be set forth hereinafter.

Donnard teaches the use of a plastic lining in combination with an aluminium casing to minimize the amount of erosive damage when hot gases escape.

Booth teaches the use of a cartridge adapter for use with revolvers in which an exterior bottle neck case involving a separate cylindrical sleeve is suitably fashioned so that a revolver that has a larger bullet chamber could thusly use a greater charge. This reference does not touch upon the internal casing geometries for the associated benefits according to the instant application.

Maillard teaches the use of a multi-pieced casing as opposed to the instant application in which the internal geometry of the casing is not the primary interest, rather the stepped portions used to crimp a bullet in the cartridge opening and the associated contours therewith are the focal point of that invention.

By way of contrast, the instant application is directed to and teaches an instrumentality for increasing the projectile velocity while not exposing the cartridge to an increased likelihood of unwanted expansion, cracking, or distortion by providing a contour and thickened areas of the casing within certain specified limits so as to provide an improved cartridge over the prior art, the contour being specifically formulated with a .41 caliber ammunition in mind. The elliptical configuration at the head end of the cartridge body involved in this instant application utilizes the axiom of the parabolic curve to direct discharged gas forces more generally against the mouth of the cartridge case, essentially in a line that is parallel to the centerline of the cartridge body from the flash hole to the cartridge mouth.

SUMMARY AND OBJECTS OF THE INVENTION

Thus, it is an object of this invention to provide a new and novel cartridge for a 0.41 caliber armament.

It is still a further object of this invention to provide a device of the character described above which increases the projectile velocity over the prior art devices.

It is still yet a further object of this invention to provide a new and novel device of the character described above which is extremely durable in construction and not prone to bulging or expansion, cracking or distortion after discharging the bullet, in which internal gas pressures are extremely high.

It is still yet a further object of this invention to provide a device of the character described above which is extremely safe to use.

A further object contemplates providing a device of the character described above which lends itself to mass production techniques.

These and other objects will be made manifest when considering the following detailed specification when taken in conjunction with the appended drawing figures.

BRIEF DESCRIPTION OF THE DRAWING FIGURES

BRIEF DESCRIPTION OF THE PREFERRED EMBODIMENT

Figure 1:
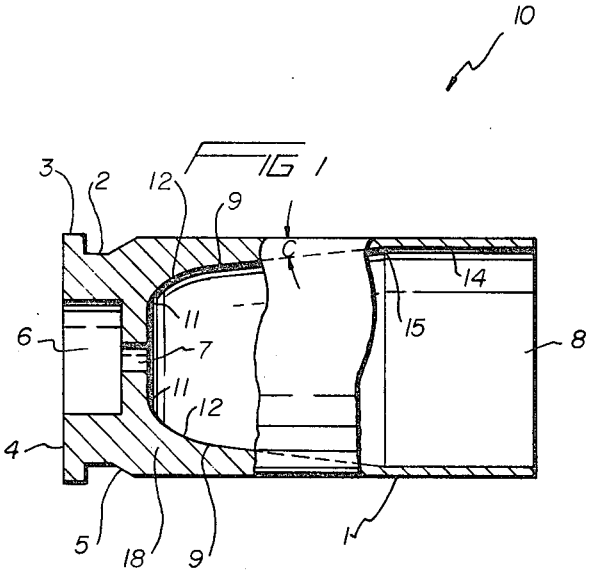
FIG. 1 is a sectional view of a portion of the cartridge according to the present invention.

Referring to the drawings now wherein like reference numerals refer to like parts throughout the various drawing figures, reference numeral 10 is directed to the cartridge according to the present invention.

The cartridge is formed with an outer casing 1 of substantially cylindrical configuration, the outer casing 1 including at one end a extractor groove portion 2 of reduced diameter, a transition bevel 5 extending between the extractor groove 2 and the outer casing 1, the extractor groove 2 terminating in a base 4 having an annularly extending rim 3 rising above the extractor groove portion 2.

The base 4 includes a means defining a recess 6 conventionally described as a primer pocket, the primer pocket 6 communicating with the casing interior 19 through a flash hole 7, the flash hole being substantially cylindrical in configuration. In one form of the invention, it is contemplated that the flash hole 7 be of comparatively reduced diameter when contrasted with the prior art so that release of gases in the casing interior occurs in a slower rate thereby providing a greater projectile velocity.

Figure 2:
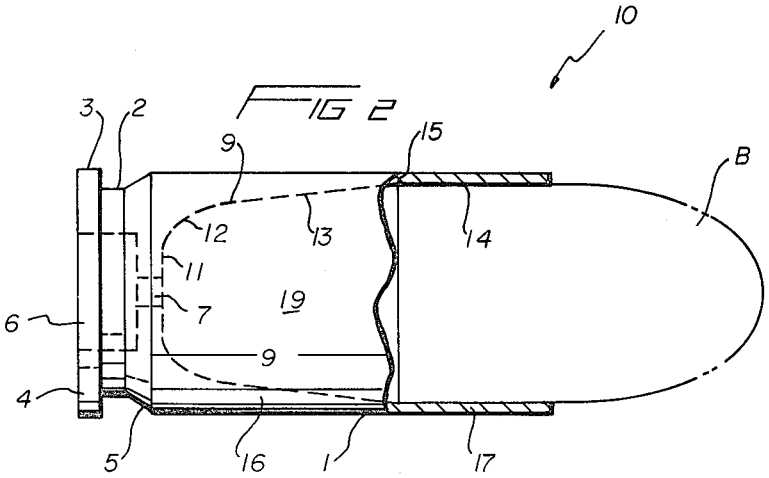
FIG. 2 is a sectional view of a further portion of the cartridge according to the present invention with a bullet schematically depicted therewithin.
Figure 3:
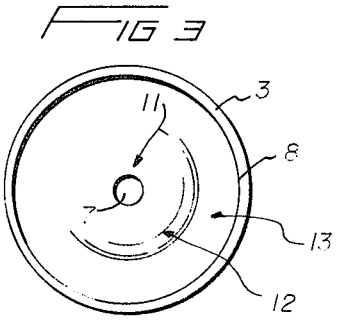
FIG. 3 is top plan view of the cartridge looking down therewithin without the bullet.

The casing interior 19 serves as a powder charge area as set forth above, and in order to further increase the gas pressure within the casing interior, the following internal configuration is most beneficial. Specifically, a planar bottom wall 11 extends radially outwardly from the flash hole 7, the planar bottom wall terminating at a curved section 12 in which the contour of the curve is substantially elliptical which causes the reflection and diffusion of forces from powder charge ignition in area 19. More particularly, the curve is a parabola so that the radiation of forces is parallel with the longitudinal axis of the cartridge. The inner diameter along line 9 is typically 0.370"±% and ends at line 11 in a diameter of 0.220"±%. Thereafter, the elliptical section 12 terminates at a line 9, the wall continuing in a linear sloped area 13, the slope defining an angle C which ranges from 5 to 15 degrees so that the wall tapers in thickness as it migrates away from the base 4, providing an area of greater thickness proximate to the base where the load imposed upon the wall by igniting the powder charge in area 19 is greatest and also where the external support or the cartridge casing in the chamber is the least. The sloped section 13 terminates at a band 15 which provides a stop for the bullet B so that thereafter a substantially linear section 14 is provided, the inner wall neck 14 running parallel to the outer casing 1 and having a uniform thickness as shown at 17. As shown in FIG. 2, the bullet B is frictionally disposed within this zone of constant uniform 17, and extending from the bullet to the neck bottom 15 the zone of constant thickness 17 is followed by a zone of increasing thickness 16, thereafter terminating in a zone of greatest thickness 18 shown in the drawing figures.

In use and operation, the cartridge 10 is formed from brass, and upon ignition, the tremendous force caused by the expanding gases within the powder charge area 19 causes the bullet to be discharged at an exceedingly high rate, the thickness of the wall being suitably fashioned as stated hereinabove to retard any bulging of the cartridge and also to minimize any likelihood of the cartridge fracturing.

Moreover, having thus described the invention, it should be apparent numerous structural modification are contemplated as being part of this invention as set forth hereinabove and defined hereandbelow by the claims.

I claim:

1. A cartridge for use with a revolver, automatic or submachine gun comprising in combination:

a single piece casing made of brass and having a substantially linear outer wall, a transition bevel at one outer wall end of said casing terminating in an extractor groove area, said extractor groove area being connected to a base which includes an annular rim, and a primer pocket extending through said base communicating with an interior of said casing through a flash hole, said interior including a powder charge area having a planar bottom wall extending radially outwardly from said flash hole terminating thereafter into a substantially parabolic curved section utilizing parabolic curve axiom that requires discharge forces to travel parallel to the longitudinal centerline of the cartridge, and an interior wall extending forward from said parabolic section, and wherein said interior wall includes a sloped wall section extending from said parabolic curved section, said sloped wall section in combination with said outer wall narrowing in thickness as it extends away from said parabolic curved section, wherein said sloped wall section terminates at a transition area which defines a lowermost nesting portion neck for a bullet disposed within said cartridge, forward said transition area thereafter providing a linear inner wall defining a zone of constant thickness with said outer wall, wherein said sloped wall section defines a zone of increasing thickness from said transition area to said parabolic curved section having a slope of 5–15 degrees, wherein said parabolic curved section defines a zone of greatest thickness of said wall, and wherein said sloped wall section is linear in longitudinal section.

* * * * *